US008107869B2

(12) United States Patent
Tamemasa

(10) Patent No.: US 8,107,869 B2
(45) Date of Patent: Jan. 31, 2012

(54) FIXING DEVICE AND IMAGE FORMING APPARATUS

(75) Inventor: Hiroshi Tamemasa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 218 days.

(21) Appl. No.: 12/560,925

(22) Filed: Sep. 16, 2009

(65) Prior Publication Data

US 2010/0196066 A1 Aug. 5, 2010

(30) Foreign Application Priority Data

Feb. 3, 2009 (JP) ..... 2009-022985

(51) Int. Cl.
*G03G 15/20* (2006.01)

(52) U.S. Cl. ..... 399/329; 219/216

(58) Field of Classification Search ..... 399/320, 399/328, 329, 330, 335; 219/216
See application file for complete search history.

(56) References Cited

U.S. PATENT DOCUMENTS

| | | | | |
|---|---|---|---|---|
| 6,136,758 | A | 10/2000 | Yamada et al. | |
| 7,212,775 | B2 | 5/2007 | Kachi | |
| 7,280,795 | B2 * | 10/2007 | Kakishima et al. | 399/341 |
| 7,643,298 | B2 | 1/2010 | Kendall | |
| 7,844,208 | B2 * | 11/2010 | Hayashi et al. | 399/329 |
| 2007/0031684 | A1 | 2/2007 | Anderson et al. | |
| 2008/0124111 | A1 | 5/2008 | Baba et al. | |
| 2008/0266804 | A1 | 10/2008 | Kendall | |

FOREIGN PATENT DOCUMENTS

| | | | |
|---|---|---|---|
| JP | A-03-106996 | | 5/1991 |
| JP | A-09-062131 | | 3/1997 |
| JP | 11174783 | A * | 7/1999 |
| JP | A-2000-063872 | | 2/2000 |
| JP | A-2001-304276 | | 10/2001 |
| JP | A-2005-316240 | | 11/2005 |
| JP | A-2006-047988 | | 2/2006 |
| JP | A-2006-267177 | | 10/2006 |
| JP | A-2008-152139 | | 7/2008 |
| JP | A-2008-152247 | | 7/2008 |
| JP | A-2009-503236 | | 1/2009 |
| WO | WO 2007/019125 | A1 | 2/2007 |

OTHER PUBLICATIONS

Office Action issued in Japanese Patent Application No. 2009-022985 dated on May 17, 2011.

Office Action issued in Japanese Patent Application No. 2009-022985, dated Dec. 14, 2010.

* cited by examiner

*Primary Examiner* — Robert Beatty

(74) *Attorney, Agent, or Firm* — Oliff & Berridge, PLC

(57) ABSTRACT

The fixing device is provided with: a fixing member that includes a metal layer; a pressure member that forms a pressure portion between the pressure member and the fixing member, and that is driven to rotate; an electromagnetic induction heating member that causes the metal layer of the fixing member to generate heat; and a heater that is disposed so as to face the electromagnetic induction heating member through the fixing member and so as to be in contact with an inner side of the fixing member, and that is caused to generate heat by a magnetic field. A heat transfer lubricant is provided between the fixing member and the heater disposed on the inner side of the fixing member.

13 Claims, 2 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Application No. 2009-22985 filed Feb. 3, 2009.

BACKGROUND

1. Technical Field

The present invention relates to a fixing device and an image forming apparatus.

2. Related Art

A fixing device employing an electromagnetic induction heating type heats a rotor by using an eddy current generated in a conductive layer by the action of an electric field of an induction coil.

SUMMARY

According to an aspect of the present invention, there is provided a fixing device including: a fixing member that includes a metal layer; a pressure member that forms a pressure portion between the pressure member and the fixing member, and that is driven to rotate; an electromagnetic induction heating member that causes the metal layer of the fixing member to generate heat; and a heater that is disposed so as to face the electromagnetic induction heating member through the fixing member and so as to be in contact with an inner side of the fixing member, and that is caused to generate heat by a magnetic field. A heat transfer lubricant is provided between the fixing member and the heater disposed on the inner side of the fixing member.

BRIEF DESCRIPTION OF THE DRAWINGS

Exemplary embodiment (s) of the present invention will be described in detail based on the following figures, wherein.

DETAILED DESCRIPTION

An exemplary embodiment of the present invention will be described below. It is to be noted that the present invention is not limited to this exemplary embodiment to be given below and may be implemented with various modifications within its scope. In addition, the drawings to be used are for illustrating this exemplary embodiment, and do not show actual dimensions.

(Image Forming Apparatus)

Figure 1:
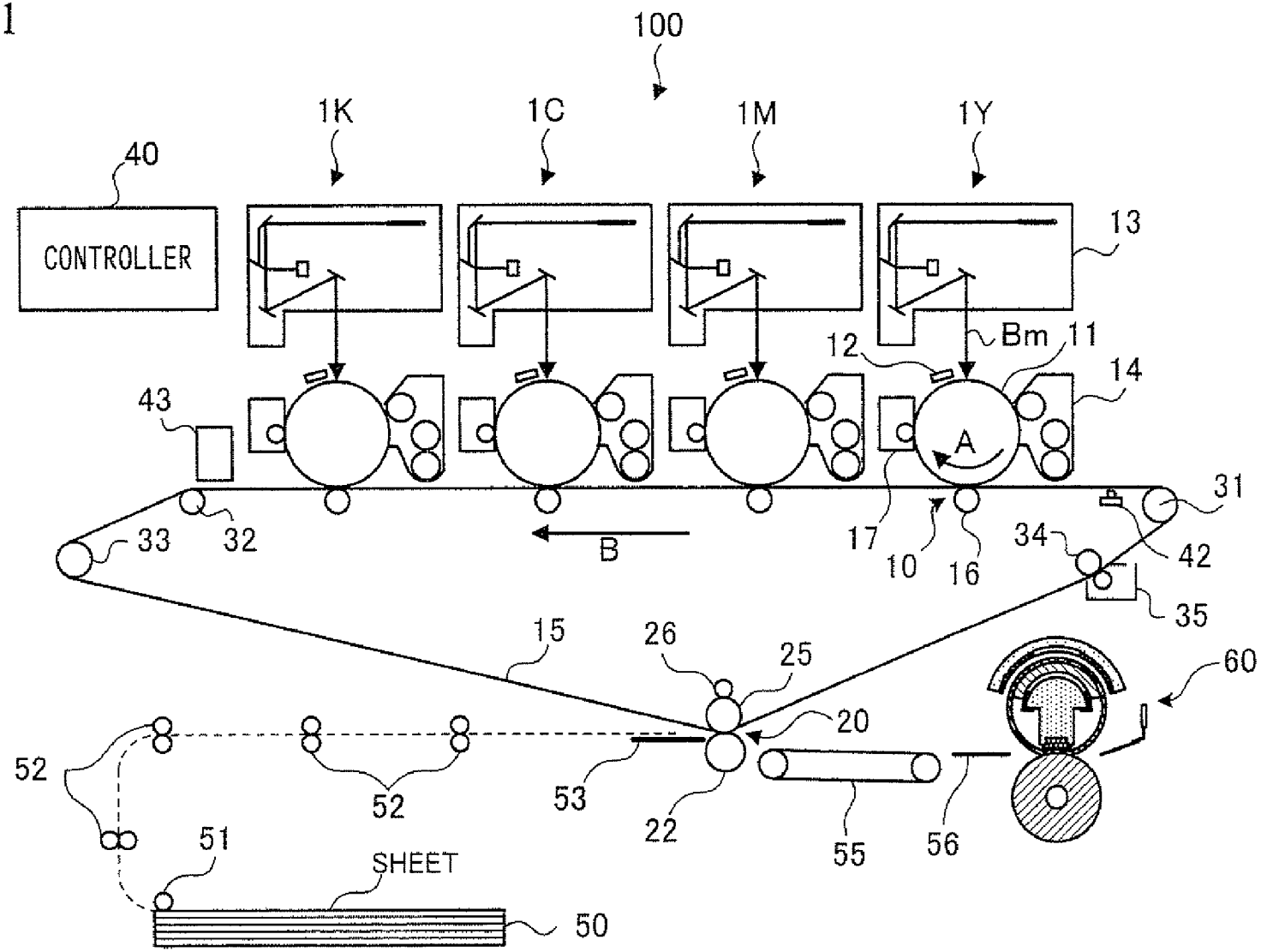
FIG. 1 is a schematic configuration diagram of an image forming apparatus to which the exemplary embodiment is applied.

FIG. 1 is a schematic configuration diagram of an image forming apparatus to which the exemplary embodiment is applied. Here, descriptions will be given by taking an image forming apparatus employing an intermediate transfer type, generally called a tandem-type image forming apparatus, as an example. An image forming apparatus 100 shown in FIG. 1 includes, as image formation units, multiple image forming units 1Y, 1M, 1C and 1K each of which forms a toner image of a corresponding color component by electrophotography. Moreover, the image forming apparatus 100 includes, as transfer units: primary transfer units 10 that sequentially transfer (primarily transfer) the toner images of the respective color components formed by the image forming units 1Y, 1M, 1C and 1K, onto an intermediate transfer belt (image holder) 15; and a secondary transfer unit 20 that collectively transfers (secondarily transfers) overlapped toner images, transferred onto the intermediate transfer belt 15, onto a sheet serving as a recording medium. Moreover, the image forming apparatus 100 includes, as a fixing unit, a fixing device 60 that fixes the secondarily transferred image on the sheet. The image forming apparatus 100 also includes a controller 40 that controls operation of each device (unit).

As shown in FIG. 1, each of the image forming units 1Y, 1M, 1C and 1K includes a photoconductive drum 11, a charging device 12, a laser-exposure device 13, a developing device 14, a primary transfer roll 16 and a drum cleaner 17. The photoconductive drum 11 rotates in an arrow A direction. The charging device 12 charges the photoconductive drum 11. The laser-exposure device 13 writes an electrostatic latent image on the photoconductive drum 11. The developing device 14 stores a toner of the corresponding color component and forms, with the toner, a visible image of the electrostatic latent image written on the photoconductive drum 11. The primary transfer roll 16 transfers, in the primary transfer unit 10, the toner image of the color component, formed on the photoconductive drum 11, onto the intermediate transfer belt 15. The drum cleaner 17 removes the toner remaining on the photoconductive drum 11. These image forming units 1Y, 1M, 1C and 1K are disposed in an approximately straight line in the order of yellow (Y), magenta (M), cyan (C) and black (K) from an upstream side of the intermediate transfer belt 15.

The intermediate transfer belt 15 is endlessly driven by various rolls in an arrow B direction shown in FIG. 1. As the various rolls, included are: a driving roll 31 that drives the intermediate transfer belt 15; a supporting roll 32 that supports the intermediate transfer belt 15; a tension roll 33 that applies certain tension to the intermediate transfer belt 15 to prevent meandering of the intermediate transfer belt 15; a backup roll 25 that is provided in the secondary transfer unit 20; and a cleaning backup roll 34 that is provided in a cleaning unit that wipes off remaining toners on the intermediate transfer belt 15.

Each primary transfer unit 10 includes the primary transfer roll 16 that faces the corresponding photoconductive drum 11 with the intermediate transfer belt 15 interposed therebetween. The secondary transfer unit 20 includes: a secondary transfer roll (transfer member) 22 that is disposed on a toner image holding surface side of the intermediate transfer belt 15; the backup roll 25 that is disposed on a back surface side of the intermediate transfer belt 15, and serves as a counter electrode to the secondary transfer roll 22; and a power feeding roll 26 that applies secondary transfer bias to the backup roll 25.

Downstream of the secondary transfer unit 20, an intermediate transfer belt cleaner 35 is disposed, which removes remaining toners and paper dust on the intermediate transfer belt 15. Upstream of the yellow image forming unit 1Y, a reference sensor (home position sensor) 42 is disposed, which generates a reference signal for coordinating timings of image formations by the image forming units 1Y, 1M, 1C and 1K. In addition, downstream of the black image forming unit 1K, an image density sensor 43 that adjusts image quality is disposed.

A sheet transportation system of the image forming apparatus 100 includes: a sheet supplying unit 50; a pickup roll 51 that picks up a sheet in the sheet supplying unit 50 and then transports the sheet; transporting rolls 52 that transport the sheet; a transporting chute 53 that sends the sheet to the secondary transfer unit 20; a transporting belt 55 that transports the sheet after secondary transfer by the secondary transfer roll 22 to the fixing device 60; and a fixing entrance guide 56 that guides the sheet to the fixing device 60.

Next, a basic image forming process of the image forming apparatus 100 will be described.

In the image forming apparatus 100 as the one shown in FIG. 1, image processing is performed on image data outputted from an image input terminal (IIT) (not shown in the figure) or the like, the image data is then converted into color tone data of the respective four colors Y, M, C and K, and thereafter the color tone data are outputted to the laser-exposure device 13. On the basis of each of the inputted color tone data, the laser-exposure device 13 emits an exposure beam Bm emitted, for example, by a semiconductor laser, to the photoconductive drum 11 of the corresponding image forming unit 1Y, 1M, 1C or 1K, the photoconductive drum 11 rotating in the arrow A direction. After a surface of each of the photoconductive drum 11 is charged by the corresponding charging device 12, the surface is scan-exposed by the laser-exposure device 13, to thereby form an electrostatic latent image. The electrostatic latent image thus formed is developed as a toner image of the corresponding color Y, C or K by the corresponding image forming unit 1Y, 1M, 1C or 1K.

Then, in the primary transfer units 10, primary transfer is performed by sequentially overlapping the toner images, formed on the photoconductive drums 11, on a surface of the intermediate transfer belt 15. The intermediate transfer belt 15 transports the toner images, to the secondary transfer unit 20 by moving in the arrow B direction. The sheet transportation system feeds a sheet from the sheet supplying unit 50 in synchronous timing with transporting of the toner images to the secondary transfer unit 20.

In the secondary transfer unit 20, the non-fixed toner image held on the intermediate transfer belt 15 is electrostatically transferred onto the sheet sandwiched between the intermediate transfer belt 15 and the secondary transfer roll 22. Thereafter, the transporting belt 55 transports, to the fixing device 60, the sheet having the toner image electrostatically transferred thereon, and then the fixing device 60 processes the non-fixed toner image on the sheet with heat and pressure to thereby fix the toner image on the sheet. The sheet having the fixed image formed thereon is transported to a sheet output portion provided to an output unit of the image forming apparatus 100.

(Fixing Device)

In order to reduce a warm-up time, an improvement has been made in recent fixing devices employing the electromagnetic induction heating type such that the thickness of a belt member including a conductive layer is reduced as much as allowed, to raise the temperature of the belt member to a temperature required for fixing operation in a short time. In this case, although the warm-up time is reduced, the temperature of the belt member tends to decrease by continuous sheet feeding. A conceivable countermeasure against this temperature decrease is to compensate the temperature decrease of the belt member by bringing a heater including a heating layer into contact with the belt member during continuous sheet feeding. In this case, excellent slidability between a belt guide member and the belt member needs to be secured.

However, lubricant used for obtaining slidability between the heater and the belt member generally contains heat-resistant oil or the like, and consequently has poor heat transfer properties in many cases. The inventor of the present invention found out that, when lubricant is provided between the heater and the belt member, the temperature of the belt member is likely to decrease during continuous sheet feeding.

Figure 2:
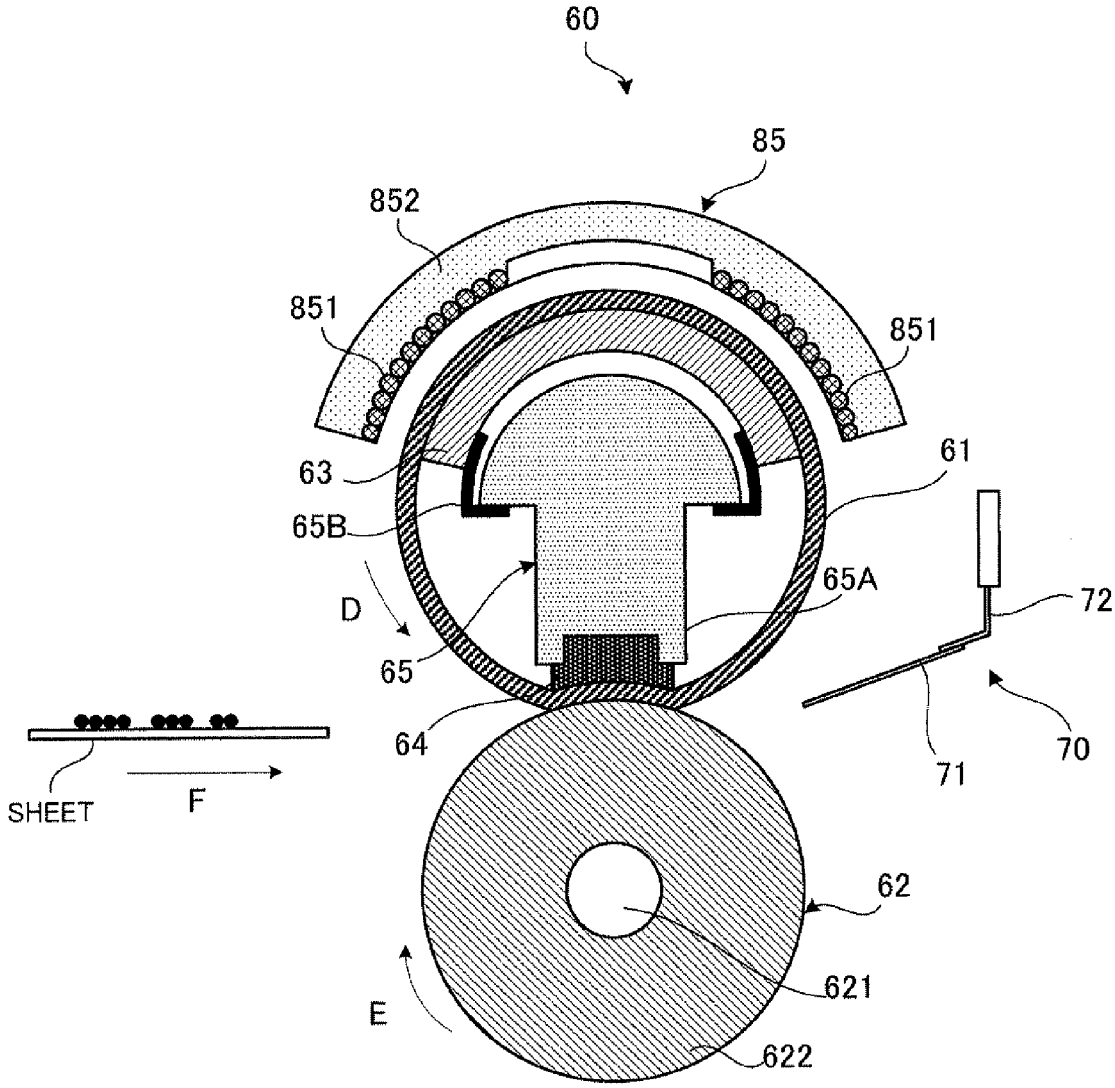
FIG. 2 is a view for illustrating an example of the fixing device to which the exemplary embodiment is applied.

A description will be given below of the fixing device. FIG. 2 is a view for illustrating an example of the fixing device to which the exemplary embodiment is applied. As shown in FIG. 2, the fixing device 60 includes: an endless fixing belt 61 (fixing member) that rotates in one direction (arrow D direction); a pressure roll 62 (pressure member) that is in contact with an outer circumferential surface of the fixing belt 61 and rotates in one direction (arrow E direction); a magnetic field generator 85 (electromagnetic induction heating member) that is disposed so as to face and to be spaced from a position of the outer circumferential surface, opposite to that of the surface being in contact with and pressed by the pressure roll 62, of the fixing belt 61; and a heater 63 that is disposed so as to face the magnetic field generator 85 with the fixing belt 61 interposed therebetween and to be in contact with an inner side of the fixing belt 61 with heat transfer lubricant provided therebetween and that generates heat by a magnetic field.

The fixing belt 61 includes, on its inner circumferential side: a fixing member (pressure pad) 64 that forms a contact part together with the pressure roll 62; and a support member 65 that supports the fixing member 64. The heater 63 is supported by the support member 65. Both side end parts of the fixing belt 61 are provided with a drive transmission member (not shown in the figure) that transmits rotational power to drive and thereby rotate the fixing belt 61.

Downstream of the contact part, between the fixing belt 61 and the pressure roll 62, in a sheet transport direction (arrow F direction), a peeling member 70 is provided. The peeling member 70 includes: a support portion 72 that is fixedly supported at one end thereof; and a peeling sheet 71 that is supported by the support portion 72. The peeling sheet 71 is disposed so that its tip end would be close to or in contact with the fixing belt 61.

The fixing belt 61 is an endless belt that is formed in a cylindrical shape, and has a diameter of approximately 20 mm to 50 mm and a thickness of 30 μm to 150 μm, for example. In the present exemplary embodiment, the fixing belt 61 preferably includes a metal layer that generates heat by itself at least by the action of a magnetic field. Examples of the fixing belt 61 are: a metal belt made of a soft magnetic material such as stainless steel, permalloy or sendust, or a hard magnetic material such as Fe—Ni—Co alloy or Fe—Cr—Co alloy; a resin belt made by stacking a metal layer and a release layer on a base made of polyimide, for example; and the like.

In the present exemplary embodiment, the metal layer contains a non-magnetic metal material. Examples of the non-magnetic metal material are copper, aluminum, silver and the like. The metal layer has a thickness of 2 μm to 20 μm. The fixing belt 61 includes, on an outer circumferential surface of the metal layer, a surface release layer (fluororesin layer, for example) having a thickness of 1 μm to 30 μm, for example. Alternatively, a belt having two stainless steel bases with the metal layer sandwiched therebetween may also be used, for example.

As the pressure roll 62, used may be, for example, a roll including a metal core 621 having a cylindrical shape and an elastic layer 622 (a silicone rubber layer or a fluororubber layer, for example) provided on a surface of the core 621. Moreover, the pressure roll 62 may include, in its outermost surface, a surface release layer (a fluororesin layer) as needed. The pressure roll 62 is disposed so that both side end parts would be pressed against the fixing member 64 with the fixing belt 61 interposed therebetween, by spring members (not shown in the figure). During preliminary heating (heating until the fixing belt 61 becomes ready for fixing), the pressure roll 62 moves to be spaced from the fixing belt 61.

The heater 63 is formed to have a shape corresponding to the inner circumferential surface of the fixing belt 61, and is disposed so as to be in contact with the inner circumferential surface of the fixing belt 61 and to face the magnetic field generator 85 with the fixing belt 61 interposed therebetween. The heater 63 is disposed so as to keep the cylindrical shape of the fixing belt 61 without being in contact with a support member main body 65A, and to be in contact with the inner circumferential surface of the fixing belt 61 without being pressed thereagainst, by spring members 65B of the support member 65. Heat transfer lubricant is provided between the heater 63 and the fixing belt 61 as will be described later.

The heater 63 generates heat by electromagnetic induction by the action of a magnetic field generated by the magnetic field generator 85, and is configured to be larger in thickness than in skin depth and to contain a magnetic metal material. The shape of the heater 63 is larger in thickness than in skin depth (0.05 mm to 1.0 mm, for example), and is, for example, a shape corresponding to a cut-out part of a cylinder having a certain range of the central angle (30° to 180°, for example).

Here, the skin depth δ (m) is expressed by the following expression by using a frequency f (Hz) of an excitation circuit, a relative permeability pr and a specific resistance ρ (Ωm).

$$\delta=503(\rho/(f*\mu r))^{1/2}$$

The above expression shows a depth of adsorption of an electromagnetic wave used in electromagnetic induction, and the electromagnetic wave has a strength not larger than 1/e when coming deeper than the depth. This indicates that adsorption of most energy is occurring to this depth. For this reason, with the outer layer having a depth δ (m) or larger, the heater 63 produces heat by the action of a magnetic field while storing the heat in its inside. Hence, temperature reduction is less likely to occur.

Examples of the magnetic metal material contained in the heater 63 are a rare-earth-containing magnetic metal material containing neodymium (Nd)—iron (Fe)—boron (B) as principal components; a magnetic metal material containing samarium (Sm)—cobalt (Co) as principal components; an alnico-containing magnetic metal material containing aluminum (Al)—nickel (Ni)—cobalt (Co) as principal components; a ferrite-containing magnetic metal material containing barium (Ba) or strontium (Sr) and iron oxide ($Fe_2O_3$) as principal components; a soft magnetic material; an oxide soft magnetic material; a magnetic shunt alloy; and the like.

In the present exemplary embodiment, a magnetic metal material may be a ferromagnetic material having a relative permeability of 100 or higher, or particularly 500 or higher.

Alternatively, in the present exemplary embodiment, a temperature-sensitive magnetic metal material having the Curie point may be used as the magnetic metal material. The Curie point may be in the range between the set temperature for the fixing belt 61 and the heat-resistant temperature of the fixing belt 61 inclusive, specifically between 170° C. and 250° C. inclusive, or particularly between 190° C. and 230° C. inclusive. As the temperature-sensitive magnetic metal material, a Ni—Fe-containing or Ni—Cr—Fe-containing magnetic shunt alloy is used, for example.

The fixing member 64 is configured of a rod-shaped member having an axis in an axial direction of the fixing belt 61, and resists the pressure acting from the pressure roll 62. The pressure roll 62 is pressed against the fixing member 64 with the fixing belt 61 interposed therebetween, and the fixing belt 61 is thereby deformed toward its inner circumferential surface side. A material of the fixing member 64 is not limited to any particular kind as long as the fixing member 64 attached to the support member 65 has a bending amount of approximately 0.5 mm or smaller when receiving the pressure from the pressure roll 62. Specifically, examples of the material of the fixing member 64 are: an elastic body such as silicone rubber; and heat-resistant resin such as polyphenylene sulfide (PPS) resin containing fiberglass, phenoric resin, polyimide resin or liquid crystal polymer resin.

The support member 65 includes the support member main body 65A and the spring members 65B that support the heater 63. The support member main body 65A may be made of a metal material, a resin material or the like, for example. When the heater 63 is made of the above-described temperature-sensitive magnetic metal material, the support member main body 65A may be made of a non-magnetic metal material (such as copper, aluminum or silver, for example). The spring members 65B are connecting members between the heater 63 and the support member main body 65A, and directly support the heater 63. The spring members 65B are connected respectively to both width-direction end parts of the heater 63.

Moreover, the spring members 65B are each formed of, for example, a curved plate spring (made of metal, for example). With the spring members 65B, the heater 63 is supported, and, even when the fixing belt 61 rotates in an eccentric manner and is thereby displaced in a radial direction thereof, the heater 63 follows the displacement and keeps the contacting state with the inner circumferential surface of the fixing belt 61.

The magnetic field generator 85 is configured to have a shape corresponding to the outer circumferential surface of the fixing belt 61, and is disposed so as to face the heater 63 with the fixing belt 61 interposed therebetween and to have a space of, for example, 1 mm to 3 mm from the outer circumferential surface of the fixing belt 61. In addition, the magnetic field generator 85 is provided with excitation coils (magnetic field generating unit) 851 disposed in an axial direction of the fixing belt 61, the excitation coils 851 wound multiple times. The excitation coils 851 are connected to an excitation circuit (not shown in the figure) that supplies an alternating current to the excitation coils 851. On surfaces of the excitation coils 851, a magnetic body member 852 is disposed to extend in a longitudinal direction of the excitation coils 851 (the axial direction of the fixing belt 61).

An output of the magnetic field generator 85 is set within such a range that the heater 63 below the Curie point would generate heat by a magnetic flux (magnetic field), for example. Specifically, the range may be 190 to 230, for example. Here, the magnetic field generator 85 may be provided on the inner circumferential surface side of the fixing belt 61 so as to have a space from the fixing belt 61. In this case, the heater 63 may be provided to be in contact with the outer circumferential surface of the fixing belt 61.

(Heat Transfer Lubricant)

The fixing device 60 to which the present exemplary embodiment is applied is provided with the heat transfer lubricant between the fixing belt 61 and the heater 63. Here, the heat transfer lubricant is lubricant that has heat transfer properties allowing heat to be transferred from the heater 63 to the fixing belt 61 so as to suppress a temperature decrease of the fixing belt 61 during fixing operation, and that improves slidability between the fixing belt 61 in rotation and the heater 63 being in contact with the fixing belt 61.

The rate of heat transfer of the heat transfer lubricant is generally 0.2 W/m·K or higher, or may be particularly 0.25 W/m·K or higher or more particularly 0.3 W/m·K or higher. Here, the rate of heat transfer of the heat transfer lubricant is generally 1.0 W/m·K or lower. If the rate of heat transfer of the heat transfer lubricant is extremely small, the heat transfer properties that are essentially, required are not likely to be obtained. Moreover, if a pure metal filler is used with which the rate of heat transfer of the heat transfer lubricant becomes extremely high, a viscosity change (gelation) of base oil is likely to occur under the influence of dissolved ion.

By providing the heat transfer lubricant between the fixing belt 61 of the fixing device 60 and the heater 63 disposed to be in contact with the fixing belt 61, an improvement in heat transfer properties reduces the warm-up time and suppresses a decrease of temperature during continuous printing, while an improvement in slidability increases the maximum speed at which continuous printing is allowed to be carried out.

In the present exemplary embodiment, the heat transfer lubricant contains base oil made of heat-resistant oil, and heat transfer powder to be mixed with the base oil. Examples of the heat-resistant oil are a fluorine-containing oil, a modified fluorine-containing oil, a silicone oil and the like.

Examples of the fluorine-containing oil are perfluoropolyether (PFPE)-containing oil, chlorotrifluoroethylene (CTFE)-containing oil, polytetrafluoroethylene (PTFE)-containing oil and the like. These fluorine-containing oils are on the market as known oils, for example, fluorine-containing lubricant DEMNUM S-65 and Daifloil #50 by Daikin Industries Ltd. and the like.

Examples of the modified fluorine-containing oil are fluorine-substituted alkyl-modified silicone oil and the like.

Examples of the silicone oil are methylphenyl silicone oil, dimethyl silicone oil, amine-modified silicone oil and the like.

Among these, the fluorine-containing oil may be often used.

A single kind of heat-resistant oil may be used, or two or more kinds of heat-resistant oil may be mixed and used.

Examples of the heat transfer powder mixed into the heat transfer lubricant are metallic compounds having an average particle size of 50 μm or smaller, and the like. Specifically, examples are alumina powder, aluminum nitride powder, boron nitride powder, silicon nitride powder, ground quartz powder, magnesium oxide powder, zinc oxide powder, tin oxide powder and the like. Alternatively, graphite-containing powder, mica powder or the like may also be used.

Among these, alumina powder and magnesium oxide powder may be often used. In addition, the rate of the heat transfer of the heat transfer powder may be 0.3 W/m·K or higher.

A single kind of heat transfer powder may be used, or two or more kinds of heat transfer powder may be mixed and used.

The heat transfer lubricant used in the present exemplary embodiment may contain a different additive or compounding agent besides the above-described heat-resistant oil and heat transfer powder. Examples of such different additive and compounding agent are stabilizer, antioxidant, aliphatic oil, aromatic oil, filler and the like.

Although the ratio between the heat-resistant oil and the heat transfer powder in the heat transfer lubricant used in the present exemplary embodiment is not limited in particular, the contained heat transfer powder is generally 20% by weight or higher in relation to the heat-resistant oil, or may be particularly 25% by weight or higher or more particularly 30% by weight or higher. Here, the ratio of the heat transfer powder is generally 60% by weight or lower.

If the ratio of the heat transfer powder to the heat-resistant oil in the heat transfer lubricant is extremely small, heat transfer properties that are essentially required are not likely to be obtained. If the ratio of the heat transfer powder to the heat-resistant oil in the heat transfer lubricant is extremely large, on the other hand, the viscosity of the lubricant is likely to increase extremely.

In the present exemplary embodiment, the fixing belt 61 may be attached to the heater 63 after the heat transfer lubricant is applied to the surface of the heater 63 to be in contact with the fixing belt 61. Alternatively, the fixing belt 61 may be attached to the heater 63 after the heat transfer lubricant is applied to the inner circumferential surface of the fixing belt 61.

In the present exemplary embodiment, the amount of the heat transfer lubricant to be used is not limited in particular, but is generally in the range of 5% to 50%, or may be particularly in the range of 10% to 40% or more particularly in the range of 20% to 30%, in relation to the area of the inner circumferential surface of the fixing belt 61.

If the amount of the heat transfer lubrication to be used is extremely small, lubricity is likely to be difficult to secure. If the amount of the heat transfer lubricant is extremely large, on the other hand, the lubricant itself is likely to hinder the heat transfer properties.

Next, operation of the fixing device 60 to which the present exemplary embodiment is applied will be described.

When the image forming apparatus 100 starts toner image forming operation, in the fixing device 60, the drive transmission member (not shown in the figure) is driven to rotate by a motor (not shown in the figure) in a state where the fixing belt 61 and the pressure roll 62 are spaced from each other, and, with this rotation, the fixing belt 61 is driven to rotate in the arrow D direction at a peripheral speed of 200 mm/sec, for example. When the fixing belt 61 starts to rotate, the excitation circuit (not shown in the figure) feeds an alternating current to the excitation coils 851 included in the magnetic field generator 85. In response to the feeding of the alternating current to the excitation coils 851, generation and disappearance of a magnetic flux (magnetic field) around the excitation coils 851 are repeated. When the magnetic flux (magnetic field) traverses the heater 63, an eddy current is generated in the heater 63 so as to generate a magnetic field that hinders a change of the magnetic field traversing the heater 63. Consequently, the heater 63 generates heat in proportion to the skin resistance of the heater 63 and the square of the amount of the current flowing in the heater 63.

Here, when the fixing belt 61 includes a heat generating layer containing a non-magnetic metal material, the magnetic flux (magnetic field) penetrates the fixing belt 61 and the heat generating layer generates heat by the action of the magnetic flux (magnetic field).

The heater 63 heats the fixing belt 61 while being rubbed with the inner circumferential surface of the fixing belt 61. In the present exemplary embodiment, the heat transfer lubricant is applied between the inner circumferential surface of the fixing belt 61 and the heater 63. The heat transfer lubricant reduces sliding resistance of the fixing belt 61, and heating by the heater 63 suppresses a temperature decrease of the fixing belt 61. Consequently, the fixing belt 61 is heated up to the set temperature (150° C., for example) in approximately 10 seconds, for example.

Subsequently, a sheet is sent to the contact part between the fixing belt 61 and the pressure roll 62 in a state where the pressure roll 62 is pressed against the fixing belt 61, and is heated and pressed by the fixing belt 61, which is heated by the heater 63, and the pressure roll 62. Thereby, the toner image is fused and transferred to the sheet by pressure, and is thus fixed on the sheet surface.

The heater 63 is configured to be larger in thickness than in skin depth and is configured by containing a magnetic metal material. For this reason, at the time of the fixing by the fixing belt 61 and the pressure roll 62, the heater 63 generates heat while storing the heat. Accordingly, even though heat of the fixing belt 61 is consumed by sheets each passing the contact part between the fixing belt 61 and the pressure roll 62, the heater 63 functions as a heat storage, and heat is transferred from the heater 63 to the fixing belt 61.

Moreover, if fixing is continuously performed on sheets smaller in size than the width of a fixing area (the length in the axial direction) of the fixing belt 61, heat is consumed in an area of the fixing belt 61, through which the sheets pass (referred to as a "sheet-passing area") while not being consumed in an area of the fixing belt 61, through which the sheets do not pass (referred to as a "non-sheet-passing area" below). Accordingly, the temperature increases in the non-sheet-passing area of the fixing belt 61.

Meanwhile, when the heater 63 is made of a temperature-sensitive magnetic metal material, a temperature increase in the non-sheet-passing area of the fixing belt 61 causes a temperature increase in an area of the heater 63 in contact with the non-sheet-passing area. When the temperature of the non-sheet-passing area of the fixing belt 61 exceeds the Curie point of the temperature-sensitive magnetic metal material forming the heater 63, the area of the heater 63 in contact with the non-sheet-passing area of the fixing belt 61 is unmagnetized, and thereby allowing the magnetic flux (magnetic field) to penetrate the area. In the area of the heater 63 which the magnetic flux (magnetic field) penetrates, the magnetic flux (magnetic field) is disordered, consequently suppressing occurrence of an eddy current and thereby reducing the amount of heat to be generated.

In the case of using the support member main body 65A made of a non-magnetic metal material, the magnetic flux (magnetic field) reaches the support member main body 65A, the eddy current mainly flows into the support member main body 65A, and thus an eddy current flowing into the fixing belt 61 is suppressed. The magnetic flux (magnetic field) penetrating the heater 63 returns to the magnetic field generator 85 by being guided by the support member main body 65A made of the non-magnetic metal material. Here, the support member main body 65A is provided not to be in contact with the heater 63, and hence the heat of the fixing belt 61 is not transferred to the support member main body 65A.

At the time of the fixing by the fixing belt 61 and the pressure roll 62, the fixing belt 61 is in contact with the heater 63 having the shape corresponding to that of the inner circumferential surface of the fixing belt 61, without being pressed thereagainst. The fixing belt 61 thus supported rotates and suppresses sliding resistance. At the same time, the fixing belt 61 absorbs asperities of the inner circumferential surface of the fixing belt 61 and receives electromagnetic force (in a direction obstructing the magnetic field from the coils). Thus, fixing is performed while the cylindrical shape of the fixing belt 61 is maintained.

When being sent out from the contact part between the fixing belt 61 and the pressure roll 62, the sheet advances straight ahead in the direction of being sent out due to its stiffness. Accordingly, the end of the sheet is peeled from the fixing belt 61, which curves and rotates. Then, the peeling member 70 comes into a position between the end of the sheet and the fixing belt 61, and consequently the sheet is peeled from the surface of the fixing belt 61.

EXAMPLES

More concrete description of the present invention will be given below on the basis of examples and comparative examples. It is to be noted that the present invention is not limited to the following examples as long as being within its scope.

Examples 1 to 10, and Comparative Examples 1 and 2

A continuous sheet feeding test is carried out by using the image forming apparatus 100 including the fixing device 60 shown in FIG. 2. The members used in the fixing device 60 are as follows.

Fixing belt 61: Used is a belt (heat resistant temperature of approximately 250 degrees C.) including a stainless steel (SUS 304) base having a diameter of 30 mm, a width of 360 mm and a thickness of 55 μm as a metal layer, and a PFA layer (PFA: copolymer of tetrafluoroethylene and perfluoroalkylvinylether) having a thickness of 30 μm and provided on an outer circumferential surface of the metal layer.

Pressure Roll 62: Used is an elastic roll, which has a diameter of approximately 30 mm and a width of 350 mm, formed of a stainless shaft having a diameter of 20 mm covered with a silicone rubber (rubber hardness 30°: JIS-A) having a wall thickness of 5 mm as an elastic layer, and with an PFA tube having a wall thickness of 30 μm covering the silicone rubber.

Heater 63: Used is a heater formed of a ferromagnetic body that has a curved plate shape corresponding to a cut-out part of a cylinder having a thickness of 0.35 mm, a length of 310 mm, a diameter of 30 mm and a center angle of 125°, and that is made of a carbon steel having a relative permeability of 500. The skin depth of the heater having this configuration is 0.1 mm or smaller.

Support member main body 65A: Used is a support member main body made of aluminum.

A fixing experiment is carried out by applying heat transfer lubricants described in Table 1, between the fixing belt 61 and the heater 63 of the fixing device 60 having the above-described configuration, the heater 63 disposed in contact with the fixing belt 61. The conditions of the fixing experiment are as follows.

In the experiment, B5 sheets are used under the conditions that the output of the magnetic field generator 85 is 1000 W, the set temperature is 185° C., and the process speed is 210 mm/s (variable). As to a feeding direction, the sheets are fed from their shorter sides. The printing speed is 35 sheets per minute (variable), and the sheet basic weight is 110 gsm.

Fixing of image is continuously performed on 500 sheets. During the fixing, measured are: warm-up time from the room temperature to the set temperature; temperature decrease (degrees C.) in the sheet-passing area during continuous printing after the warm-up time (the temperature decreases at the beginning since the sheets rapidly draw heat from the fixing belt 61, but increases again in response to feeding of thermal energy from the heater 63 to the fixing belt 61); maximum speed at which continuous printing is allowed (sheets/minute); and maximum driving torque (sliding torque) (N·m) during continuous printing. The results are shown in Table 1.

TABLE 1

| | | Lubricant | | | | | | Evaluation result | | | |
|---|---|---|---|---|---|---|---|---|---|---|---|
| | | | Heat transfer powder 1 | | Heat transfer powder 2 | | | | | | |
| | | Base oil | Type | Contain amount (Weight part) | Type | Contain amount (Weight part)) | Rate of heat transfer (cal/cm · sec · degrees C.) | Warm-Up Time | Temperature decrease during continuous printing (degrees C.) | Maximum speed at continuous printing (sheets/min) | Maximum driving torque (N · m) |
| Examples | 1 | Fluorine-containing oil | Alumina | 25 | — | — | $2 \times 10^{-3}$ | 14 | 22 | 35 | 0.63 |
| | 2 | Fluorine-containing oil | Aluminum nitride | 30 | — | — | $3 \times 10^{-3}$ | 13 | 18 | 35 | 0.65 |
| | 3 | Fluorine-containing oil | graphite | 35 | — | — | $4 \times 10^{-3}$ | 12 | 16 | 35 | 0.66 |
| | 4 | Fluorine-containing oil | Alumina | 20 | Ground quartz | 20 | $5.5 \times 10^{-3}$ | 11 | 14 | 35 | 0.68 |
| | 5 | Fluorine-containing oil | Alumina | 25 | Aluminum nitride | 20 | $6 \times 10^{-3}$ | 10 | 13 | 45 | 0.7 |
| | 6 | Modified fluorine-containing oil | Alumina | 28 | — | — | $2.5 \times 10^{-3}$ | 13 | 20 | 35 | 0.64 |

TABLE 1-continued

| | | Lubricant | | | | | | Evaluation result | | | |
|---|---|---|---|---|---|---|---|---|---|---|---|
| | | | Heat transfer powder 1 | | Heat transfer powder 2 | | | | | | |
| | | Base oil | Type | Contain amount (Weight part) | Type | Contain amount (Weight part)) | Rate of heat transfer (cal/cm · sec · degrees C.) | Warm-Up Time | Temperature decrease during continuous printing (degrees C.) | Maximum speed at continuous printing (sheets/min) | Maximum driving torque (N · m) |
| | 7 | Modified fluorine-containing oil | Boron nitride | 33 | — | — | $3.5 \times 10^{-3}$ | 12 | 17 | 35 | 0.65 |
| | 8 | Modified fluorine-containing oil | Ground quartz | 38 | — | — | $4.5 \times 10^{-3}$ | 11 | 15 | 35 | 0.67 |
| | 9 | Modified fluorine-containing oil | Alumina | 25 | Boron nitride | 25 | $8 \times 10^{-3}$ | 9 | 12 | 45 | 0.72 |
| | 10 | Modified fluorine-containing oil | Alumina | 30 | Silicon nitride | 25 | $2 \times 10^{-2}$ | 8 | 10 | 45 | 0.75 |
| Comparative Examples | 1 | Fluorine-containing oil | — | — | — | — | $5 \times 10^{-5}$ | 20 | 40 | 20 | 0.6 |
| | 2 | Modified fluorine-containing oil | — | — | — | — | $4 \times 10^{-5}$ | 20 | 40 | 20 | 0.55 |

The results shown in Table 1 indicate the following facts. In the case of providing heat transfer lubricant (Examples 1 to 10) containing heat-resistant oil and heat transfer powder between the fixing belt 61 and the heater 63, in contact with the fixing belt 61, of the fixing device 60 in the fixing device employing the electromagnetic induction heating type, heat transfer properties are improved, thereby reducing the warm-up time and suppressing a decrease of the temperature during continuous printing. At the same time, slidability is also improved, thereby increasing the maximum speed at which continuous printing is allowed.

By contrast, in the case of using lubricant not containing heat transfer powder (Comparative Examples 1 and 2), the following facts are revealed. Heat transfer properties are not improved, consequently a warm-up time and a temperature decrease during continuous printing are not reduced. In addition, the maximum speed at which continuous printing is allowed does not increase.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that includes a metal layer;

a pressure member that forms a pressure portion between the pressure member and the fixing member, and that is driven to rotate;

an electromagnetic induction heating member that causes the metal layer of the fixing member to generate heat; and a heater that is disposed so as to face the electromagnetic induction heating member through the fixing member and so as to be in contact with an inner side of the fixing member, and that is caused to generate heat by a magnetic field, a heat transfer lubricant being provided between the fixing member and the heater disposed on the inner side of the fixing member, wherein the heat transfer lubricant contains base oil made of heat-resistant oil, and heat transfer powder, and a rate of heat transfer of the heat transfer lubricant is not less than 0.2 W/m·K and is not more than 1.0 W/m·K.

2. The fixing device according to claim 1, wherein the heat-resistant oil contained in the heat transfer lubricant contains one material selected from a fluorine-containing oil, a modified fluorine-containing oil, and a silicone oil.

3. The fixing device according to claim 1, wherein the heat-resistant oil contained in the heat transfer lubricant contains a fluorine-containing oil.

4. The fixing device according to claim 1, wherein the heat transfer powder is a metallic compound having an average particle size of not more than 50 μm.

5. The fixing device according to claim 1, wherein the heat transfer powder includes one material selected from alumina powder, aluminum nitride powder, boron nitride powder, silicon nitride powder, ground quartz powder, magnesium oxide powder, zinc oxide powder, tin oxide powder, graphite-containing powder, and mica powder.

6. The fixing device according to claim 1, wherein the heat transfer powder includes one material selected from alumina powder and magnesium oxide powder.

7. The fixing device according to claim 1, wherein a rate of the heat transfer of the heat transfer powder is not less than 0.3 W/m·K and not more than 1.0 W/m·K.

8. The fixing device according to claim 1, wherein a ratio of the heat transfer powder to the heat-resistant oil in the heat transfer lubricant is not less than 20% by weight and not more than 60% by weight.

9. The fixing device according to claim 1, wherein the heater contains a magnetic metal material that is caused to generate heat by the electromagnetic induction heating member.

10. A fixing device comprising:

a fixing member that includes a metal layer;

a pressure member that forms a pressure portion between the pressure member and the fixing member, and that is driven to rotate;

an electromagnetic induction heating member that causes the metal layer of the fixing member to generate heat; and a heater that is disposed so as to face the electromagnetic induction heating member through the fixing member and so as to be in contact with an inner side of the fixing member, and that is caused to generate heat by a magnetic field, a heat transfer lubricant being provided between the fixing member and the heater disposed on the inner side of the fixing member, wherein an amount of the heat transfer lubricant to be used is in a range of 5% to 50% in relation to an area of an inner circumferential surface of the fixing member.

11. An image forming apparatus comprising:

an image formation unit that forms a toner image;

a transfer unit that transfers the toner image onto a recording medium; and a fixing unit that fixes the toner image transferred on the recording medium, onto the recording medium, the fixing unit including:

a fixing member that includes a metal layer which is caused to generate heat by a magnetic field;

a pressure member that forms a pressure portion between the pressure member and the fixing member, and that is driven to rotate;

a heater that is caused to generate heat by a magnetic field, that is disposed so as to be in contact with an inner side of the fixing member, and that is provided with a heat transfer lubricant between the heater and the fixing member; and an electromagnetic induction heating member that is disposed so as to face the heater through the fixing member, and that causes the heater and the fixing member to generate heat by a magnetic field generated by an alternating current, wherein a rate of heat transfer of the heat transfer lubricant is not less than 0.2 W/m·K and is not more than 1.0 W/m·K.

12. The image forming apparatus according to claim 11, wherein the heat transfer lubricant provided to the heater contains heat transfer powder that is 20% to 60% by weight in relation to a base oil.

13. The image forming apparatus according to claim 11, wherein the heater of the fixing unit is disposed on an inner side of the fixing unit by a support member made of a non-magnetic metal material.

* * * * *